US006147658A

United States Patent [19]

Higashi et al.

[11] Patent Number: 6,147,658

[45] Date of Patent: Nov. 14, 2000

[54] ARRAY ANTENNA DEVICE AND RADIO EQUIPMENT

[75] Inventors: Kazutaka Higashi, Hirakata; Ikuo Takakuwa, Suita, both of Japan

[73] Assignee: Murata Manufacturing Co., Ltd., Japan

[21] Appl. No.: 09/346,810

[22] Filed: Jul. 2, 1999

[30] Foreign Application Priority Data

Jul. 6, 1998 [JP] Japan ..... 10-190866

[51] Int. Cl.[7] ..... H01Q 1/38

[52] U.S. Cl. ..... 343/853; 333/167; 343/700 MS

[58] Field of Search ..... 343/853, 824, 343/749, 835, 700 MS; 333/167, 236, 239

[56] References Cited

U.S. PATENT DOCUMENTS 3,121,848 2/1964 Kruse et al. ..... 333/10

5,414,434 5/1995 Conant et al. ..... 343/700 MS 5,617,103 4/1997 Koscica et al. ..... 343/700 MS 5,943,005 8/1999 Tanizaki et al. ..... 342/175

*Primary Examiner*—Don Wong

*Assistant Examiner*—James Clinger

*Attorney, Agent, or Firm*—Ostrolenk, Faber, Gerb & Soffen, LLP

[57] ABSTRACT

A dielectric line has a conductor plate and dielectric strip on the side of a fixed portion and a dielectric line including a conductor plate and dielectric strip on the side of a moving portion. A directional coupler comprises the dielectric lines. On a dielectric plate of an array antenna portion a plurality of linear array antennas are formed and connected to a microstrip as a feed portion. By displacement of the moving portion, the feed point to the feed portion is changed and the feed phase to each linear array antenna and the feed power to each element antenna are changed. Thus, the direction of a beam is changed.

16 Claims, 12 Drawing Sheets

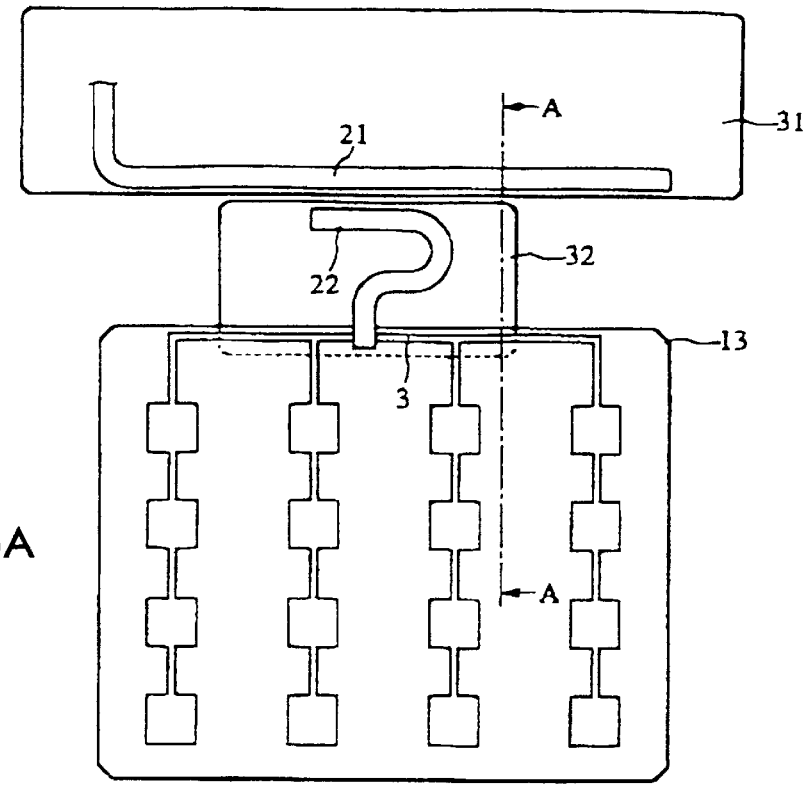
FIG. 5A
FIG. 5B
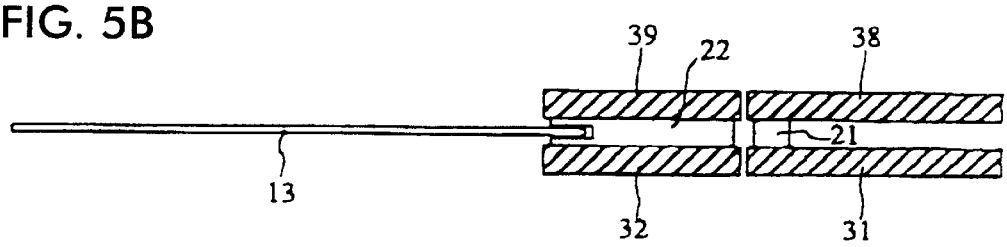
FIG. 6
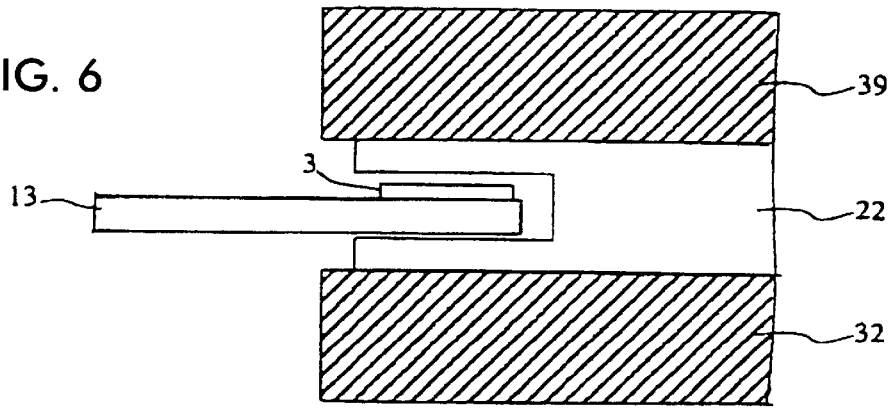

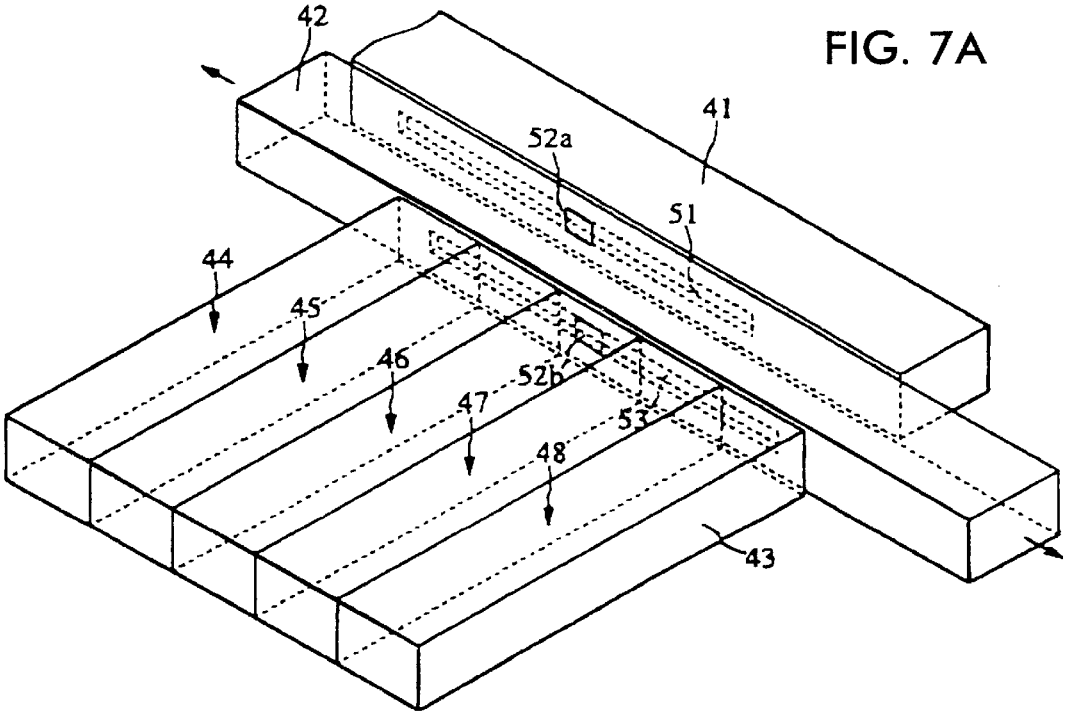
FIG. 7A
FIG. 7B
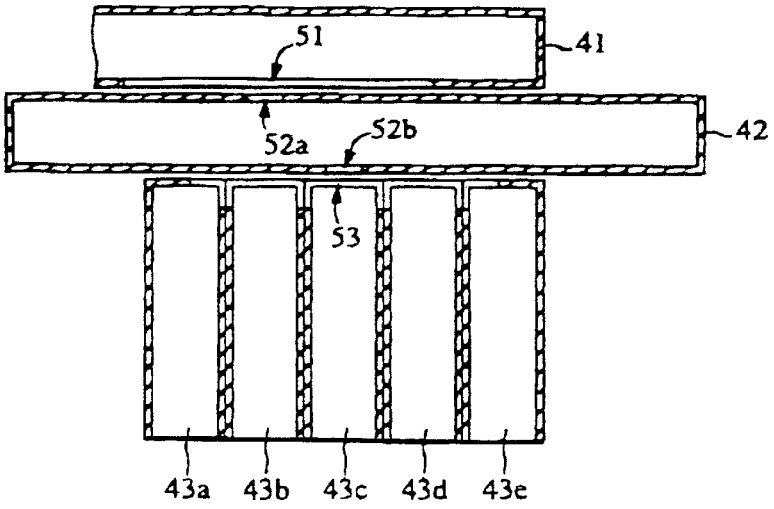

FIG. 8A
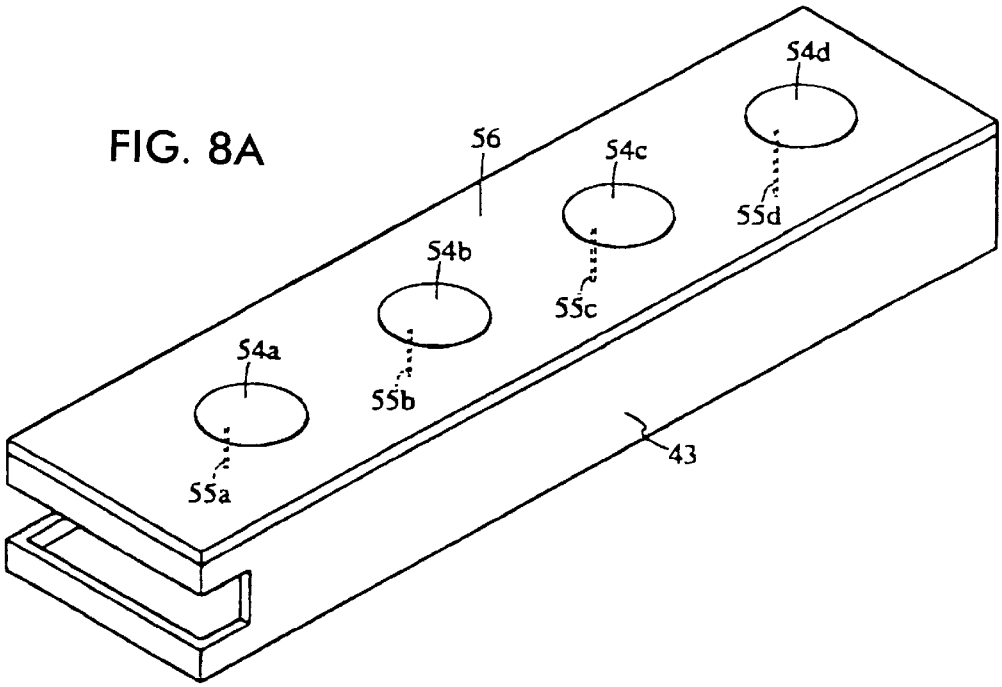
FIG. 8B
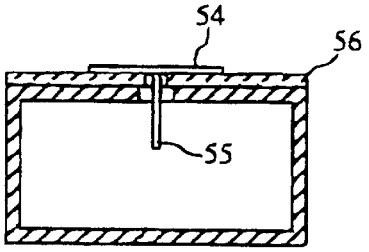
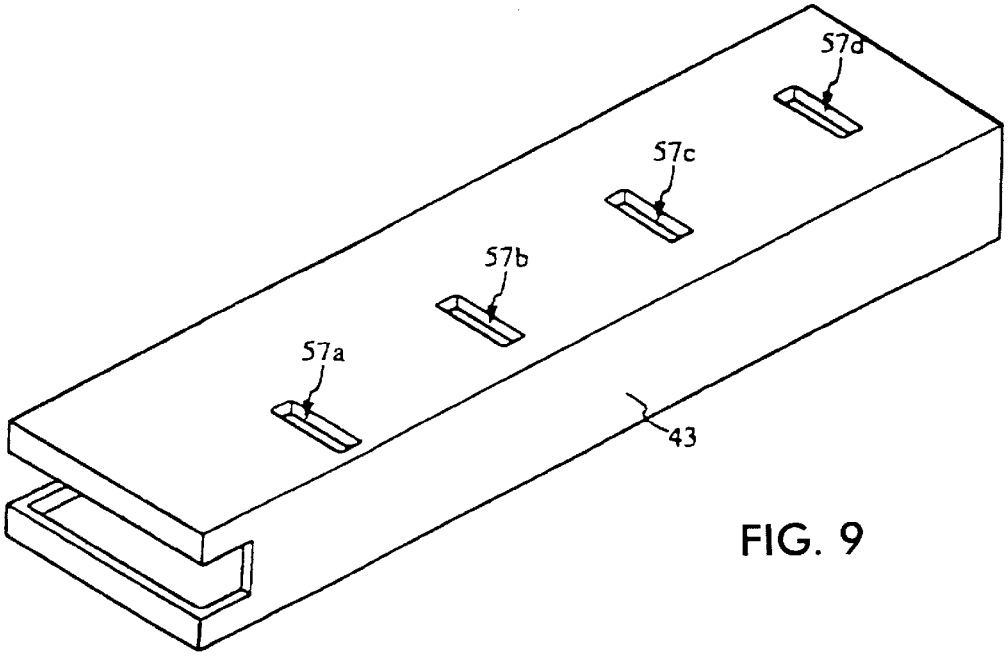
FIG. 9

ARRAY ANTENNA DEVICE AND RADIO EQUIPMENT

BACKGROUND OF THE INVENTION

1. Field of the Invention

The present invention relates to an array antenna device allowing the radiation direction of a beam to be changed and radio equipment using such device.

2. Description of the Related Art

An array antenna having a plurality of arranged radiator elements takes advantage of the easy synthesis of a directional pattern and is used in the field where high functions are required to be filled.

One characteristic feature of an array antenna is that high-speed beam scanning can be done. Up to now, the beam scanning in such array antennas is divided into two main classes of a mechanical scanning system and an electronic scanning system. In the electronic scanning system, there are (1) a phase scanning system, (2) a frequency scanning system, and (3) a scanning system including switching feed points.

In the phase scanning system ((1)), as shown in FIG. 16, the feed phase of each element antenna is controlled by a phase shifter, and the synthesis of a directional pattern is made.

In the frequency scanning system ((2)), the frequency characteristic of a feeder is utilized, and the synthesis of a directional pattern is made by changing the excitation phase of each element antenna.

In the scanning system of switching feed points ((3)), a beam is changed by selectively switching input points to a multi-terminal array antenna which is able to generate a multi-beam.

In the above frequency scanning system, the antenna itself is able to be relatively easily constructed, but as a wide frequency band is required the transmitter-receiver system becomes complicated. Further, in the phase scanning system, scanning with a high degree of freedom can be done in accordance with the control of phase shifters. However, because high-cost semiconductor elements and electronic switches for ultra high frequency applications are required in the phase shifters and their control circuit, there is a problem that low-cost systems cannot be realized as a whole. Further, in the scanning system of switching feed points, because the direction of a beam is changed by using hybrid circuits and phase shifters and switching input ports, the beam scanning becomes step-wise and accordingly the system is not suited for finer scanning and continuous scanning.

Moreover, in the mechanical scanning system, as shown in FIG. 17, scanning is conducted by rotating (swinging) the whole of a planar antenna using a motor and so on, and accordingly as the total antenna is displaced, there was a problem that the system becomes large-sized and heavy.

SUMMARY OF THE INVENTION

It is an object of the present invention to solve the above-mentioned existing problems and present an array antenna device able to easily conduct beam scanning through the synthesis of a directional pattern and radio equipment using such device.

The present invention comprises an array antenna having a plurality of element antennas connected therebetween and a linear feed portion to be used in common by the plurality of element antennas, a first line to transmit a transmission signal or reception signal, and a second line electromagnetically coupled to the first line and the feed portion respectively to transmit signals between the first line and the feed portion, wherein the second line is provided so as to be able to be displaced freely with reference to the first line and the feed portion. When the coupling position of the second line to the feed portion is changed, the feed phase and feed power to the plurality of element antennas connected to the feed portion are changed, and the directivity of a beam dependent on the feed phase and feed power is changed.

FIG. 1 shows examples of construction of an array antenna device according to the present invention. In the example shown in FIG. 1(A), a second line is relatively displaced in the direction of right and left as the second line is electromagnetically coupled to the first line and the feed portion. By displacement of the second line, the feed point of the second line to the feed portion is changed. Because the line length between two element antennas and the feed point is changed, the feed phase and feed power to the two element antennas are changed. By this, the directivity of a composite beam by the two element antennas is changed.

FIG. 2 shows the relation of the declination (tilt angle) of the centerline of a beam to the displacement of the feed point. As the feed point is displaced toward the right in (A) of FIG. 1, the feed phase to the element antenna on the right side is more advanced and the feed power is more increased than to the element antenna on the left side, and accordingly the centerline of the beam is tilted toward the left.

This is true in the cases of three or more element antennas. Further, for example, in the example shown in (B) of FIG. 1, a linear array antenna comprises of a plurality of element antennas arranged in a straight line, and the feed phase and feed power to each element antenna are changed in accordance with the displacement of the feed point to the feed portion.

Further, in the example shown in (C) of FIG. 1, linear array antennas having a plurality of element antennas arranged on a straight line are disposed in parallel, and a planar array antenna comprises these linear array antennas connected to a feed portion. The case of FIG. 1(D) disposed in the same way.

Further, in the present invention, a plurality of linear array antennas made up of a plurality of element antennas are disposed nearly in parallel and connected to a feed portion, and a feeder circuit is provided so that the excitation amplitude distribution of each element antenna is of an equal amplitude distribution.

For example, as shown in FIG. 14(A), a linear array antenna is composed of eight element antennas arranged in the y direction so that the excitation amplitude of each element antenna is nearly equal.

FIG. 14(B) shows the distribution of the excitation amplitude of each element antenna in the y direction. Here, the gray area means the excitation amplitude of voltage or current contributing to the radiation, and the white area means the portion not contributing to the radiation. FIG. 1(C) shows the distribution of only the excitation amplitude of each element antenna. On the contrary, when all the element antennas of the linear array antenna are made to be the same, as shown in (D) and (E) of FIG. 14, the distribution of the excitation amplitude of each element antenna is exponentially decreased as each element antenna is located further away from the feed portion.

In the invention, as the excitation amplitude distribution of each element antenna becomes of an equal amplitude distribution, the aperture efficiency is increased and the gain is improved. Further, the direction of the beam becomes normal to the linear array antenna as shown in FIG. 15, and because a plane making a right angle with the direction of the disposition of the linear array antenna, that is, a plane normal to the plane where an array antenna has been formed, is scanned with the beam, the capability of being put into an assembly of equipment is improved.

Further, in the present invention, first and second lines are composed of dielectric lines, and a feed portion is composed of a microstrip line. When constructed in this way, a directional coupler of dielectric lines which are able to be relatively displaced from each other, is able to be easily constructed by using the first and second lines, and on the board comprising the feed portion, patch antennas of a microstrip are easily constructed. So, a small-sized array antenna device as a whole is able to be obtained.

Further, in the invention, radio equipment is constructed in such a way that using the array antenna device a driving means is provided to displace a second line relative to a first line and feed portion and a transmitter circuit or receiver circuit is connected to the first line. Under such construction, the drive by the driving means and the operation of the transmitter circuit or receiver circuit causes the beam to turn to a fixed direction to be able to easily transmit or receive a signal. As the above driving means is to displace only the portion of the second line, a small motor or the like is enough. Accordingly, the radio equipment is able to be made small-sized and low-cost. Furthermore, it is possible to control the direction of the beam at fine intervals or continuously.

BRIEF DESCRIPTION OF THE DRAWINGS

FIG. 1, comprises

FIG. 3, comprises

FIG. 4, comprising

FIG. 5, comprising FIGS. 5A and 5B, shows the construction of an array antenna device according to a third embodiment;

FIG. 6 is a segmentary enlarged sectional view of FIG. 5;

FIG. 7, comprising FIGS. 7A and 7B, shows the construction of an array antenna device according to a fourth embodiment;

FIG. 8, comprising FIGS. 8A and 8B, shows the construction of a linear array antenna of the array antenna device shown in FIG. 7;

FIG. 9 shows the construction of another linear array antenna of the array antenna device shown in FIG. 7;

FIG. 10, comprising

FIG. 11, comprising

FIG. 14, comprising

DESCRIPTION OF THE PREFERRED EMBODIMENT

The construction of an array antenna according to a first embodiment is explained with reference to FIG. 3.

Figure 3A:
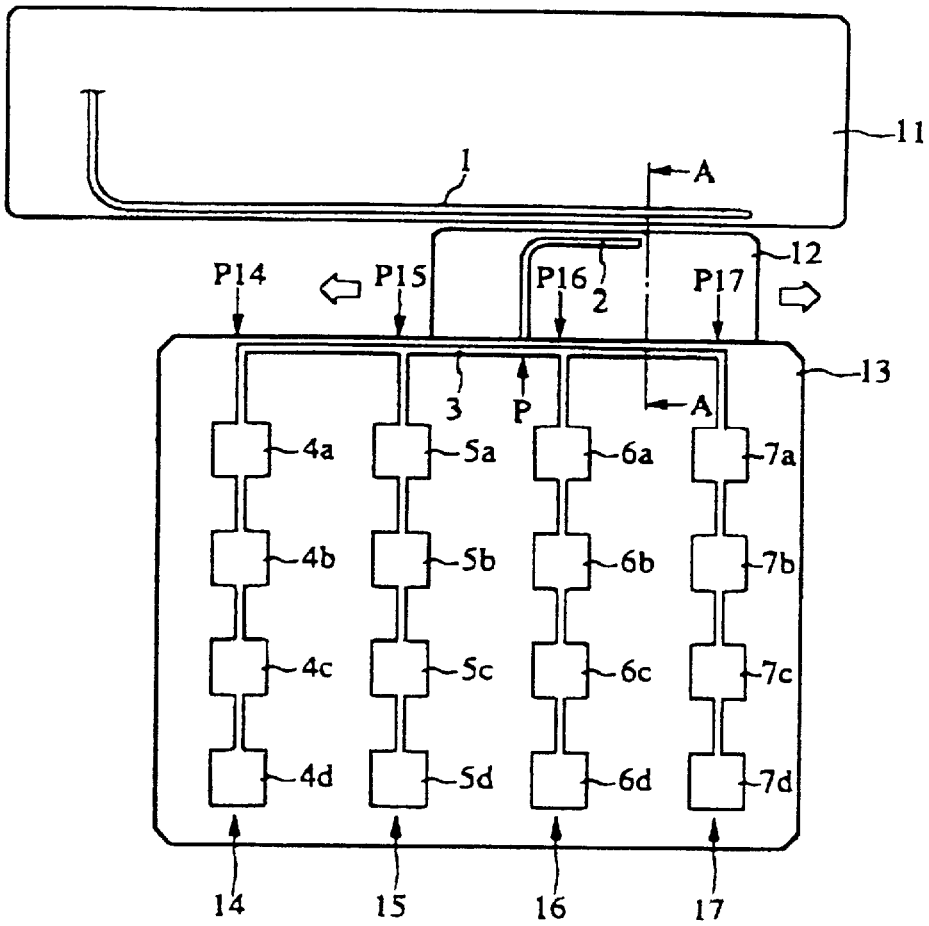
FIGS. 3A and 3B, shows the construction of an array antenna device according to a first embodiment.
Figure 3B:
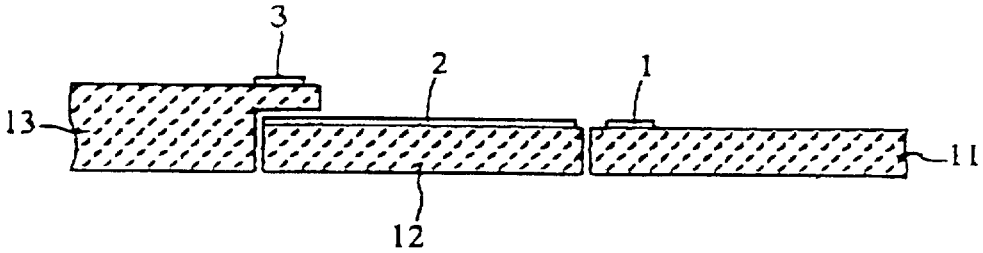

FIG. 3A shows a top view of an array antenna device and FIG. 3B shows a sectional view taken on line A—A of FIG. 3A. In FIG. 3, reference numeral 11(B) is represents a dielectric plate on the side of a fixed portion, and on the nearly whole surface of the lower side a grounding electrode is formed and on the upper surface a microstrip line as a first line is formed. Reference numeral 12 represents a dielectric plate on the side of a moving portion, and on the nearly whole surface of the lower side a grounding electrode is formed and on the upper side a microstrip line as a second line is formed. Reference numeral 13 represents a dielectric plate of an array antenna portion, and on the upper surface patch antennas indicated by 4*a* through 4*d*, 5*a* through 5*d*, 6*a* through 6*d*, and 7*a* through 7*d* are formed and the patch antennas are connected in series using feed lines as shown in the figure. These patch antennas constitute four linear array antennas 14, 15, 16, and 17. These linear array antennas are connected to a feed portion 3. That is, the feed portion 3 branches.

As shown in FIG. 3B, the end portion of the second line 2 provided on the dielectric plate 12 is arranged in proximity to the feed portion 3 provided on the dielectric plate 13 of the array antenna portion and in this part electromagnetic coupling is provided. The microstrip line 1 and microstrip line 2 arranged in parallel in proximity to each other constitute a directional coupler. In this example, the directional coupler (hereinafter, called a 0 dB coupler) is designed so that all of the input power is propagated to the output side, and most of the sending power from the microstrip line 1 is propagated to the microstrip line 2. Most of the received power is propagated from the microstrip line 2 to the microstrip line 1.

Figure 1A:
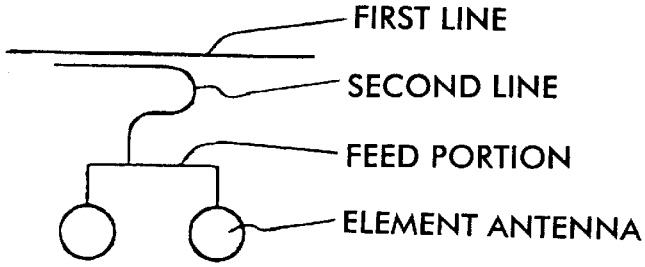
FIGS. 1A to 1D, shows examples of construction of an array antenna device according to the present invention.
Figure 1B:
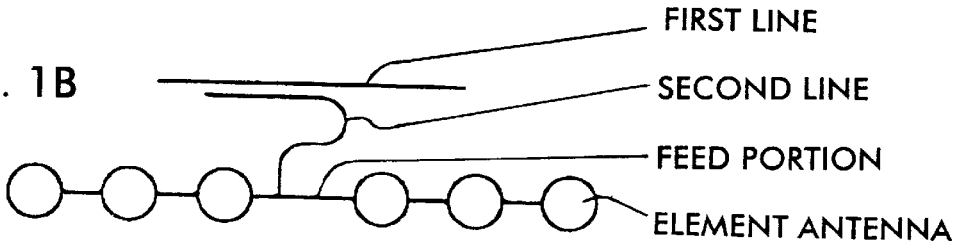
Figure 1C:
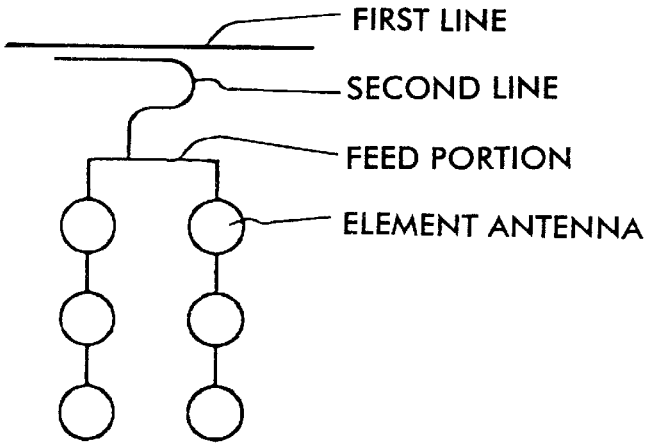
Figure 1D:
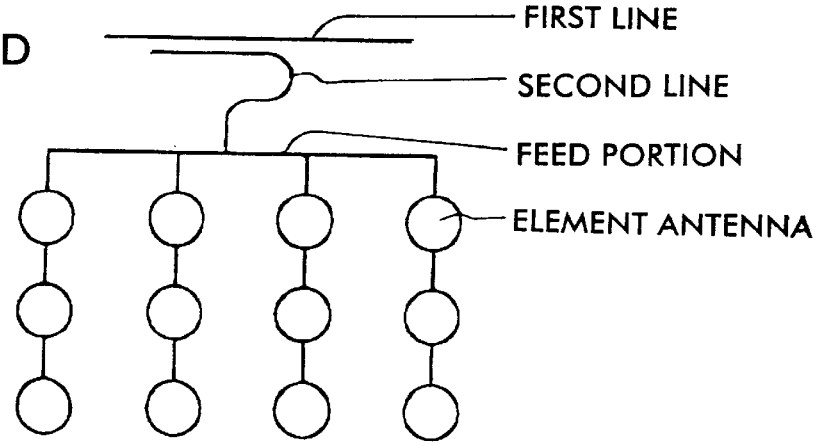
Figure 2:
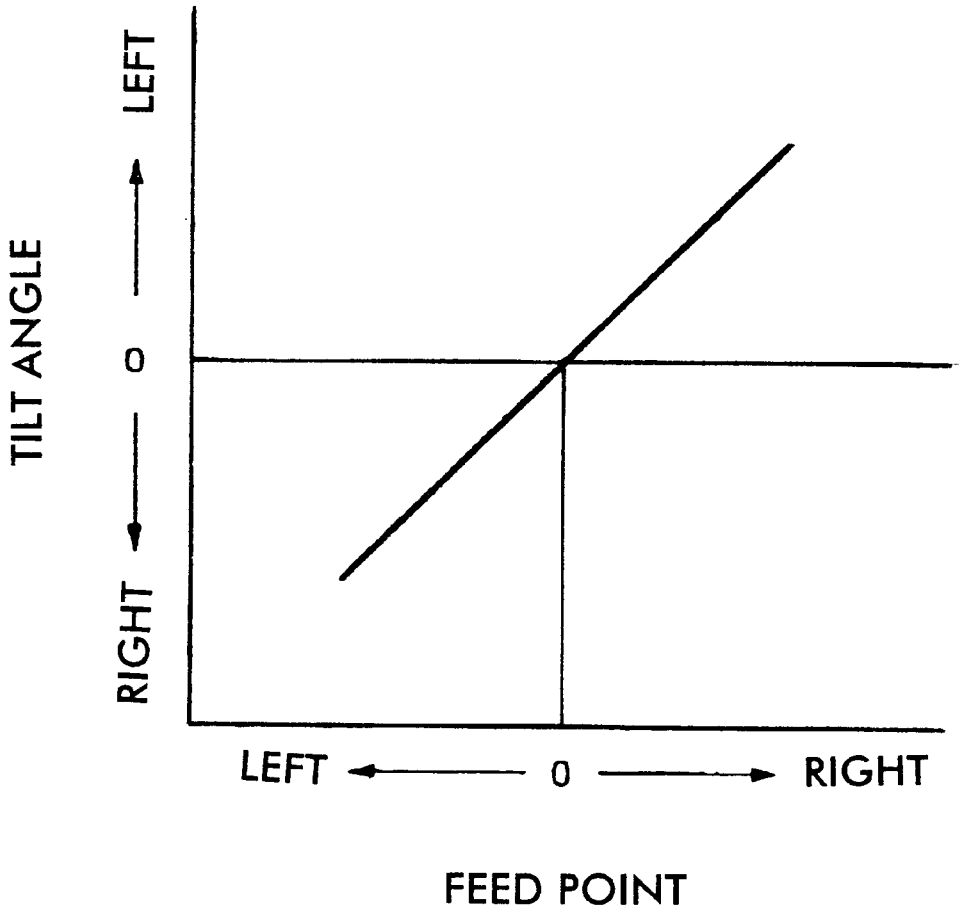
FIG. 2 shows an example of the change of tilt angle to feed point in an array antenna device.

The spacing between the patch antennas of each of the linear array antennas 14 through 17 is set to be one wavelength or an integral multiple of one wavelength. In the example shown in FIG. 2A, the feed point to the feed portion 3 by the microstrip line 2 is at the location indicated by P, but by displacement of the dielectric plate 12 as a moving portion in the direction of right and left in the figure the feed point is changed from P14 to P17. When the feed point is located just at the middle point between P15 and P16, a feed of the same phase is given to the linear array antenna 14 of 4*a* through 4*d* and the linear array antenna 17 and a feed of the same phase is given to the linear array antennas 15 and 16 in like manner. Therefore, in this case, the feed phase and feed power to each of the patch antennas are symmetrical about the midpoint of right and left or the feed point, and accordingly the centerline of the beam is to be normal to the dielectric plate 13 of the array antenna portion and in a plane in parallel with the linear array antennas 14 through 17.

If the dielectric plate 12 as a moving portion is displaced toward the right from the above-mentioned state and shifted from the center to the right as shown in FIG. 3A, the feed phase to the linear array antennas 16 and 17 is more advanced than the feed phase to the linear array antennas 14 and 15. Further, the difference is caused between the impedance looking toward the side of the linear array antennas 16 and 17 from the point P and the impedance looking toward the side of the linear array antennas 15 and 14 from the point P, and the feed power to each of the patch antennas of the linear array to antennas 16 and 17 becomes larger than the feed power to each of the patch antennas of the linear array antennas 14 and 15. Therefore, the centerline of the beam is to be tilted toward the left.

However, when the feed point is further moved over one wavelength, the feed phase periodically varies in accordance with the movement of the feed point. Accordingly, the relation between the movement of the feed point and the change of the tilt angle of the beam to be caused by displacement of the moving portion is not linear.

Based on the space between the connection points of the linear array antennas 14 through 17 to the feed portion 3 and the feed point, it is possible to calculate the feed phase and feed power to each element antenna of the linear array antennas beforehand, and the change of the directional pattern and the centerline of the beam in accordance with the change of the feed point to the feed portion is able to be simulated beforehand. Further, the actual measurement is also possible. Therefore, it is enough only to decide the position of the dielectric plate 12 so that the feed is made at a point required to realize a fixed directional pattern and direction of the beam.

Next, the construction of an array antenna device according to a second embodiment is explained with reference to FIG. 4.

Figure 4A:
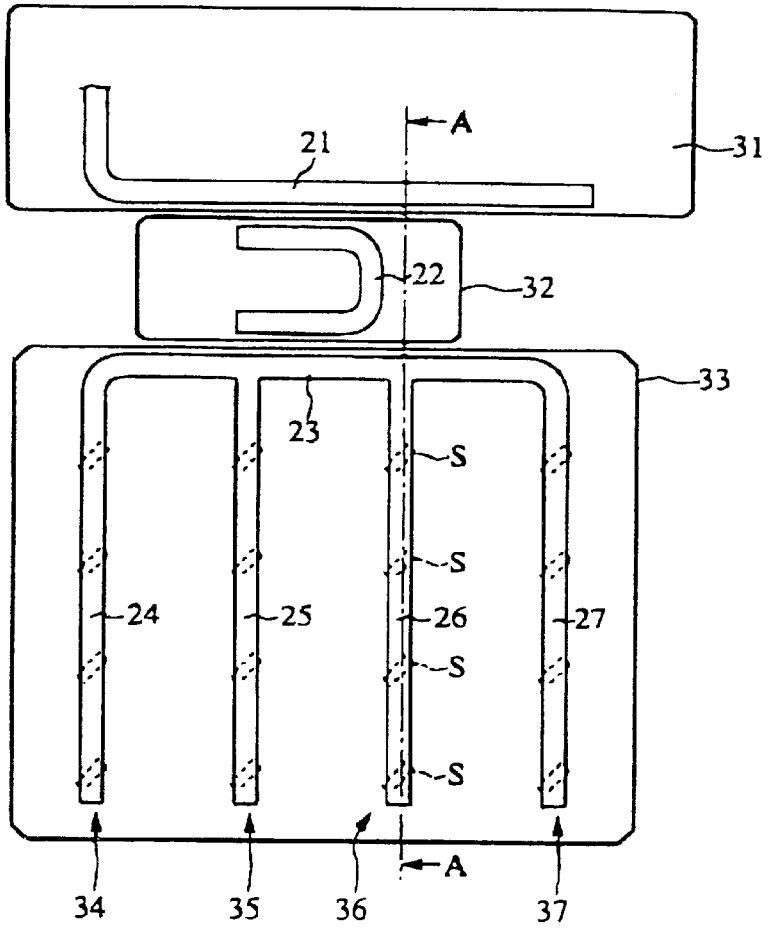
FIGS. 4A and 4B, shows the construction of an array antenna device according to a second embodiment.
Figure 4B:
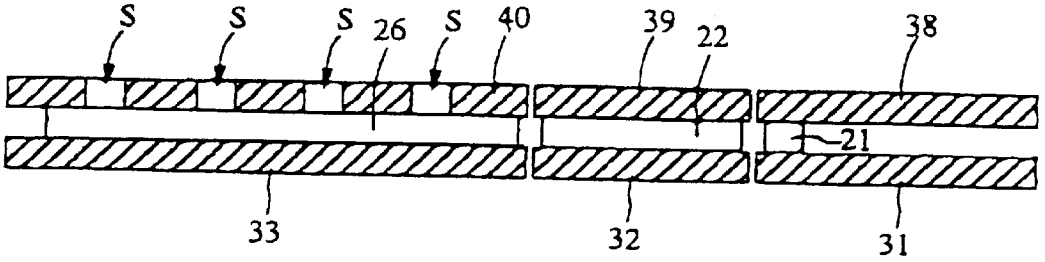

In the example, dielectric lines are utilized. FIG. 4*a* shows a top view of the array antenna device with the upper conductor plate removed, and FIG. 4B is a sectional view taken on line A—A of FIG. 4A. Reference numeral 31 represents a lower conductor plate of a dielectric line on the side of a fixed portion, and the dielectric line is composed in such a way that a dielectric strip 21 is sandwiched between an upper conductor plate 38 and the lower conductor plate. Reference numeral 32 represents a lower conductor plate constituting a dielectric line of a moving portion, and the dielectric line is composed in such a way that a dielectric strip 22 is sandwiched between an upper conductor plate 39 and the lower conductor plate. Reference numeral 33 represents a lower conductor plate of a dielectric line of an array antenna portion, and the dielectric line is composed in such a way that dielectric strips 23 through 27 are sandwiched between an upper conductor plate 40 and the lower conductor plate. Out of these, the dielectric strip 23 constitutes a feed portion, and the dielectric strips 24 through 27 branch out of fixed positions of the feed portion 23.

In the upper conductor plate 40 along the dielectric strips 24 through 27 a plurality of slots indicated by S are given. At these slots electromagnetic waves being propagated along the dielectric lines are to be radiated. Linear array antennas 34 through 37 are composed of these dielectric strips 24 through 27 and slots.

A dielectric line on the side of the fixed portion, of the dielectric strip 21 and a dielectric line on the side of the moving portion, of the dielectric strip 22 constitute a directional coupler as a 0 dB coupler. Further, a dielectric line of the feed portion, of the dielectric strip 23 and a dielectric line on the side of the moving portion, of the dielectric strip 22 constitute a directional coupler as a 0 dB coupler. Therefore, regardless of the position of the moving portion, most of the sending power is transmitted to the feed portion through the dielectric line of the moving portion and most of the received power is transmitted to the dielectric line on the side of the fixed portion through the dielectric line of the moving portion.

When the moving portion is displaced in the direction of right and left in the figure, the feed point to the feed portion 23 is moved. The relation of the feed phase to the linear array antennas and the amplitude of each element antenna (slot antenna) to displacement of the moving portion is the same as in the first embodiment.

Next, the construction of an array antenna device according to a third embodiment is explained with reference to FIGS. 5 and 6.

This array antenna device comprises of a dielectric line and a microstrip line. FIG. 5A shows a top view of the array antenna device with the upper conductor plate of the dielectric line portion removed, and FIG. 5B is a sectional view taken on line A—A of FIG. 5A. Further, FIG. 6 is a segmentary enlarged sectional view of FIG. 5B. In these figures, reference numeral 31 represents a lower conductor plate of a dielectric line on the side of a fixed portion, and the dielectric line is composed in such a way that a dielectric strip 21 is sandwiched between an upper conductor plate 38 and the lower conductor plate. Reference numeral 32 represents a lower conductor plate constituting a dielectric line of a moving portion, and the dielectric line is composed in such a way that a dielectric strip 22 is sandwiched between an upper conductor plate 39 and the lower conductor plate. Reference numeral 13 represents a dielectric plate of an array antenna portion on the upper surface of which a plurality of patch antennas are formed and connected using feed lines as shown in the figure. Thus, four linear array antennas are constructed. These linear array antennas are connected to a feed portion 3.

The construction of the dielectric plate 13 of the array antenna portion is the same as what is shown in the first embodiment. A dielectric line made up of the dielectric strip 22 and the upper and lower conductor plates of the strip is made at a right angle with the feed portion composed of a microstrip line of the array antenna portion as shown in FIG. 6. Thus, a signal of LSM 01 mode being propagated along the dielectric line of the moving portion and the microstrip line are magnetically coupled.

A dielectric line on the side of the fixed portion, of the dielectric strip 21 and a dielectric line on the side of the moving portion, of the dielectric strip 22 constitute a directional coupler as a 0 dB coupler. When the moving portion is displaced in the direction of right and left in the figure, the feed point to the feed portion 3 is moved. The relation of the feed phase to the linear array antennas and the feed power to each patch antenna to displacement of the moving portion is the same as in the first embodiment.

Next, the construction of an array antenna device according to a fourth embodiment is explained with reference to FIGS. 7 through 9.

FIG. 7A shows a total perspective view of the array antenna device and FIG. 7B is its horizontal sectional view. In the figure, reference numeral 41 represents a wave guide on the side of a fixed portion, 42 a wave guide on the side of a moving portion, and 43 a wave guide of an array antenna portion. The wave guide 42 is displaced between the wave guides 41 and 43 in the direction of arrows shown in the figure. As shown in FIG. 7B, a slit 51 is formed on the side surface facing the wave guide 42, of the wave guide 41, and an opening portion 52*a* is formed on the side surface facing the wave guide 41, of the wave guide 42. In like manner, a slit 53 is formed on the side surface facing the wave guide 42, of the wave guide 43, and an opening portion 52*b* is formed on the side surface facing the wave guide 43, of the wave guide 42. Thus, the wave guides 41 and 43 are coupled through the wave guide 42.

In this example, the wave guide 43 is made up of five wave guide portions indicated by 43*a* through 43*e*, and the end portion of each wave guide portion has an opening as a slit 53 and in the neighboring portions an opening portion is formed. Accordingly, in accordance with the position of the opening portion 52*b* to the slit 53 the degree of coupling to each of the wave guides 43*a* through 43*e* is changed. On the upper surface of each of the wave guides 43*a* through 43*e* a plurality of element antennas are given as mentioned later and the element antennas constitute linear array antennas 44 through 48.

FIG. 8 shows the construction of a linear array antenna of each of the wave guide portions 43*a* through 43*e* shown in FIG. 7. FIG. 8A is a perspective view showing the construction of one wave guide portion, and FIG. 8B is its sectional view. Further, FIG. 9 is a perspective view showing the construction of another linear array antenna.

In the example shown in FIG. 8, on the upper surface of the wave guide 43 (any one of 43*a* through 43*e*) a dielectric plate 56 is arranged. On the upper surface of the dielectric plate 56 patch antennas indicated by 54*a* through 54*d* are formed. On the upper surface of the wave guide 43 opening portions are formed at the positions corresponding to the lower portion of each of the patch antennas 54*a* through 54*d*, and coupling pins 55*a* through 55*d* protrude inside the wave guide at each of the patch antennas. In this example, on this and left-hand side in FIG. 8A, the slit 53 provided on the wave guide as a moving portion is to be formed, and becomes a feed portion. The nearer to the feed portion, the shorter the coupling pin 55 is made, and the farther from the feed portion, the longer the coupling pin is made. Thus, the distribution of the excitation amplitude of each patch antenna is made to be an equal amplitude distribution.

In the example shown in FIG. 9, slots indicated is by 57*a* through 57*d* are formed on the upper surface of the wave guide 43, and linear array antennas are composed of slot antennas. In this case, this and the left-hand surface also constitutes a feed portion. The farther from the feed portion, the nearer to the middle of the wave guide the slot is displaced, and the distribution of the excitation amplitude of each slot is made to be an equal amplitude distribution.

Next, a segmentary perspective view and sectional view of an array antenna device according to a fifth embodiment is shown in FIG. 10. In the example shown in FIG. 4, the slots were formed in the upper conductor plate of the dielectric line along the dielectric strip and a linear array antenna is composed of slot antennas. However, in the fifth embodiment a feed circuit is composed of a dielectric line, and patch antennas are given.

Figure 10A:
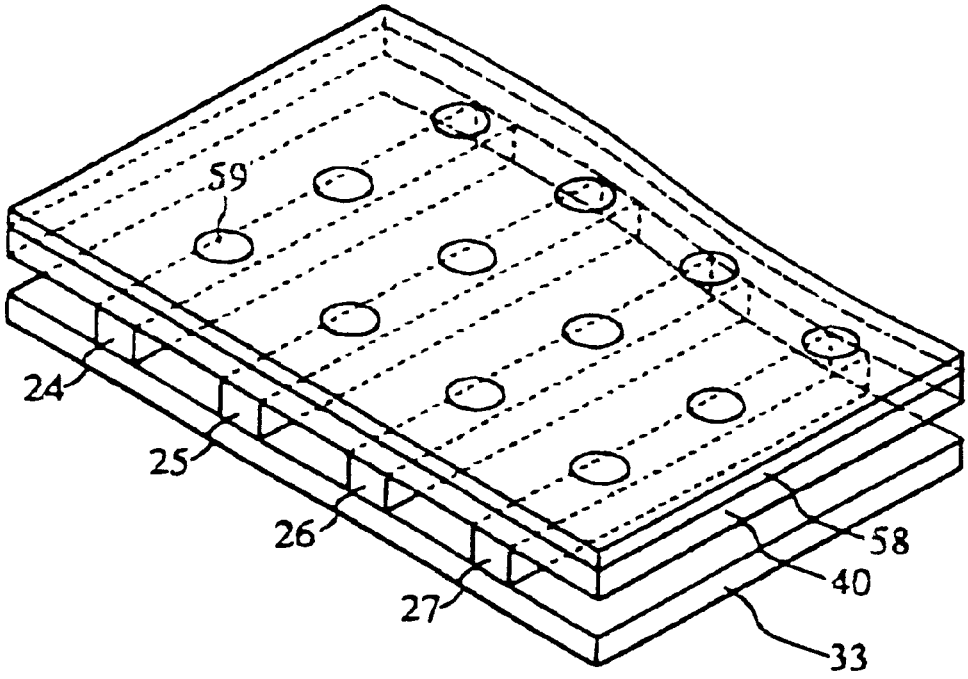
FIGS. 10A and 10B, shows the construction of an array antenna device where a feed circuit comprises a dielectric line.
Figure 10B:
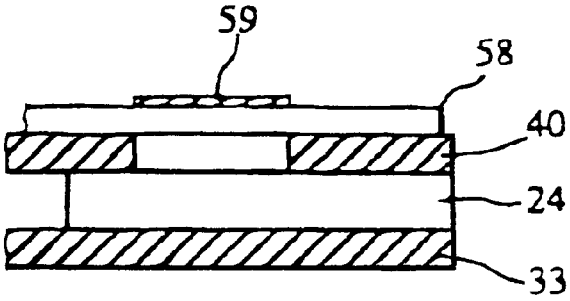

FIG. 10A shows a segmentary perspective view of the array antenna device and FIG. 10B is a segmentary sectional view of the device. In FIG. 10, reference numeral 59 represents patch antennas as element antennas, and the patch antennas are arranged at fixed positions on the surface of a dielectric plate 58. In the upper conductor plate 40 of dielectric lines, opening portions are formed along dielectric strips, and over these opening portions the patch antennas 59 are arranged to be positioned. Thus, the feed is given by causing the dielectric strip 24 to be electromagnetically coupled to the patch antenna 59.

Figure 11A:
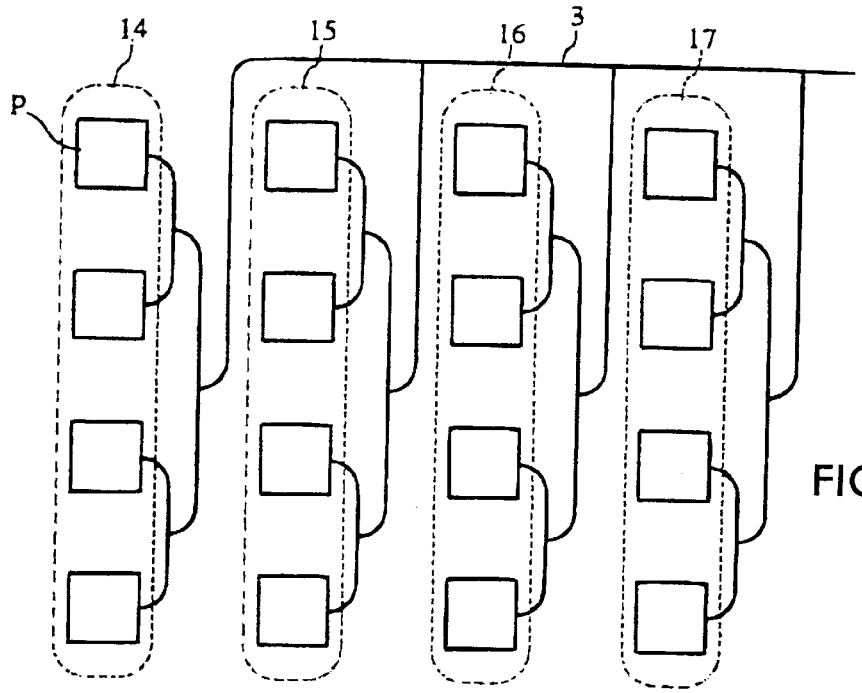
FIGS. 11A and 11B, shows the construction of a feed circuit of an array antenna device having an equal amplitude distribution and an arrangement of patch antennas.

Next, another example where the distribution of the excitation amplitude of each element antenna is made to be an equal amplitude distribution is shown in FIG. 11. In the figure P represents each of patch antennas formed on a dielectric plate, and reference numerals 14 through 17 constitute linear array antennas. As shown in FIG. 11A, by applying two-forked microstrip lines to each linear array antenna repeatedly a feed circuit like tournament selection is constructed. The feed circuit to each linear array antenna is connected to a microstrip line 3 as a feed portion. Thus, the distribution of the excitation amplitude of each patch antenna on one linear array antenna becomes an equal amplitude distribution.

Figure 11B:
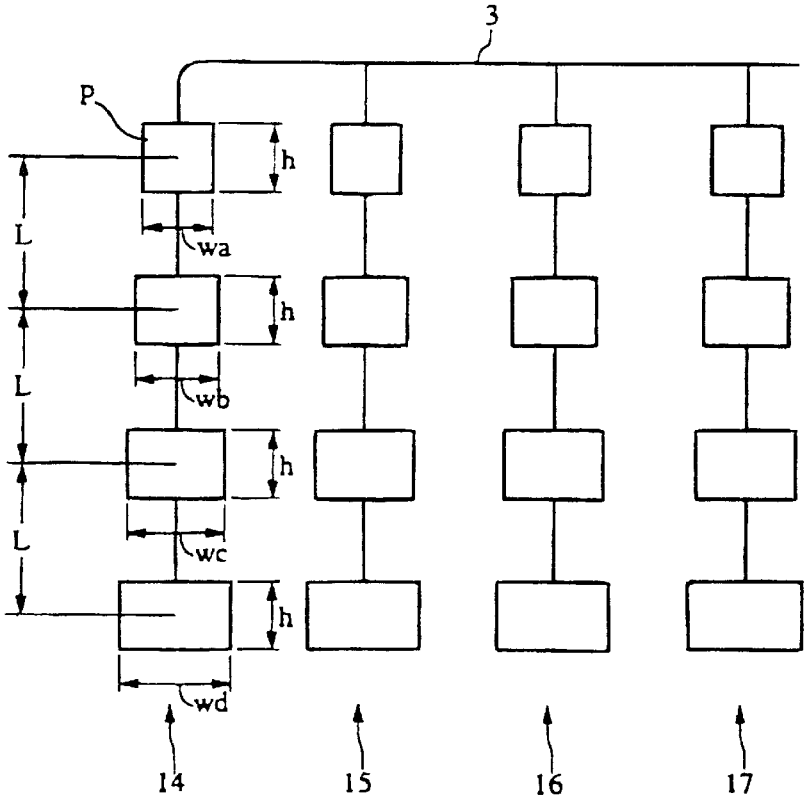

Further, in the example shown in FIG. 11B, patch antennas are connected in series, and the farther the patch antennas P of each linear array antenna are separated from the feed portion 3, the wider the widths wa through wd are made. In the example, the space L between the patch antennas and the height h of each patch antenna are made to be the same. When constructed in this way, the farther separated from the microstrip line 3 as the feed portion the patch antennas are, the more decreased the feed power is, but the decrease is corrected in accordance with the sizes of the patch antennas and the distribution of the excitation amplitude of each patch antenna on one linear array antenna becomes an equal amplitude distribution.

In this way, by making the distribution of the excitation amplitude of each element antenna an equal amplitude distribution, the aperture efficiency is increased and the gain is improved. Further, a plane at a right angle to the direction of the arrangement of the linear array antenna, that is, a plane normal to the plane where the array antenna is formed is able to be scanned with the beam. When a fan-shaped plane is scanned with the centerline of a beam, generally a plane normal to a certain plane of an equipment is scanned with the beam. However, by making use of the above operation, only the arrangement of an array antenna in parallel with a plane of an equipment is required and accordingly the capability of being put into an assembly of equipment is improved. Further, in the construction of a linear array antenna of a plurality of patch antennas connected in series which is connected to a feed portion, when each patch antenna is made to have the same shape, the nearer to the feed portion the patch antenna is, the larger the excitation amplitude becomes. Accordingly, the centerline of the beam is to be inclined to the side of the feed portion (head direction of the paper in the example shown in FIG. 11).

Moreover, in FIG. 11, the feed circuit is composed of microstrip lines, but the feed circuit like tournament selection shown in FIG. 11A may be made up of dielectric lines. In that case, the two-forked portion is able to be constructed by using a 3 dB directional coupler which divides power equally.

Figure 12:
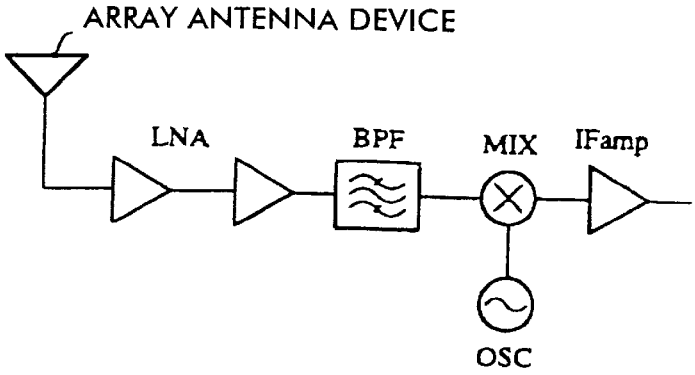
FIG. 12 is a circuit diagram showing an example of radio equipment.

Next, the construction of a radio equipment using the above various array antenna devices is shown in FIG. 12. In this example, an array antenna device is used as a reception antenna. A two-stage low-noise amplifier LNA increases gain of a receiving signal, and a band-pass filter BPF selects only the component of a fixed frequency band. An oscillator OSC generates a local signal, and a mixer MIX combines the output signal from the band-pass filter BPF and the local signal and produces an intermediate-frequency signal. This signal is increased by an intermediate-frequency amplifier IF amp and transmitted to a reception circuit portion.

Figure 13:
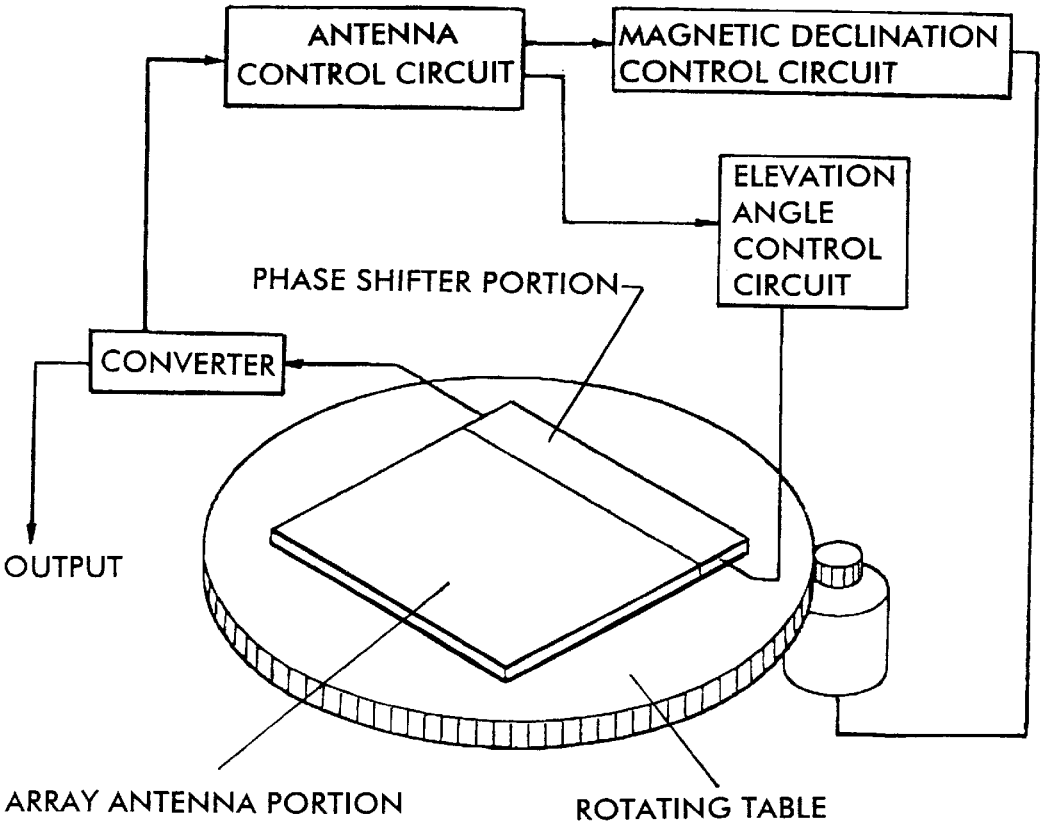
FIG. 13 is a block diagram showing the construction of another embodiment of radio equipment.
Figure 14A:
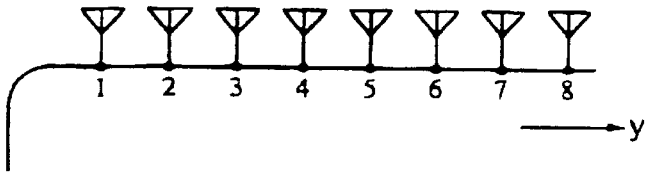
FIGS. 14A to 14E, shows examples of an equal amplitude distribution and an exponential distribution concerning the excitation amplitude of a linear array antenna.
Figure 14B:
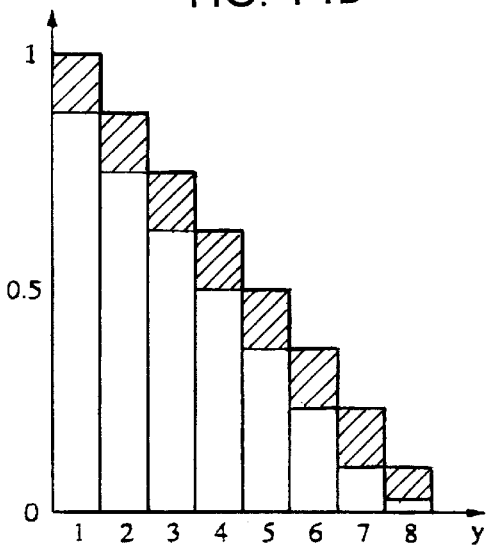
Figure 14D:
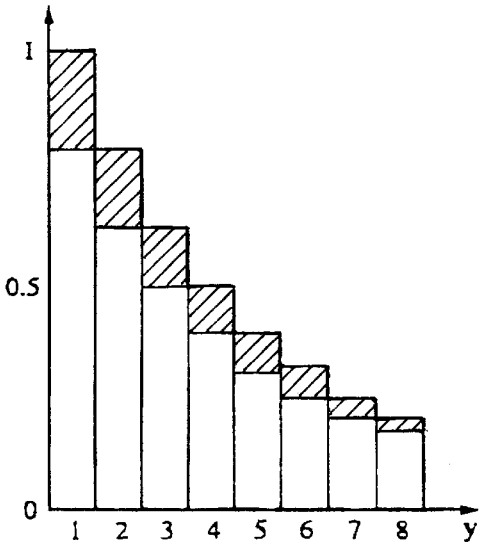
Figure 14C:
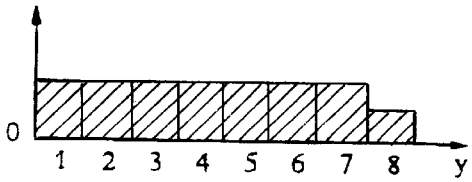
Figure 14E:
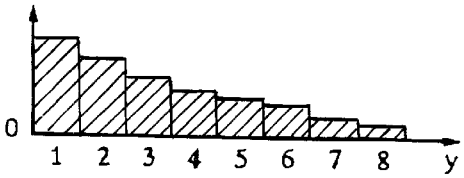
Figure 15:
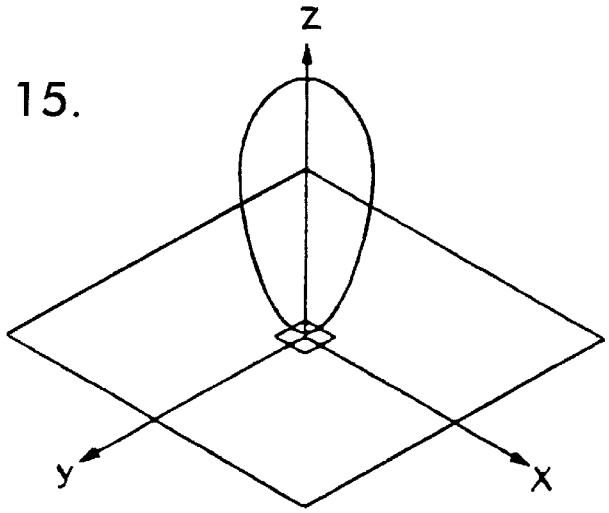
FIG. 15 shows the direction of a beam based on an equal amplitude distribution.
Figure 16:
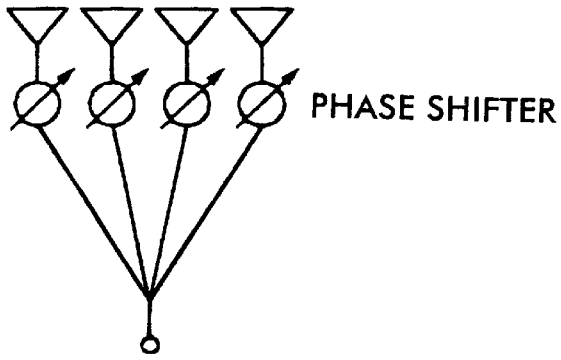
FIG. 16 shows the construction of an array antenna of a conventional phase scanning system.
Figure 17:
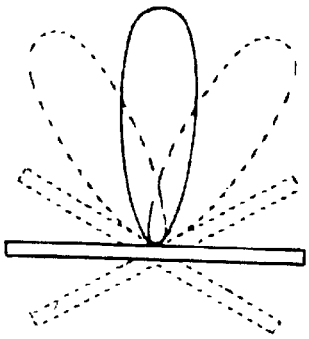
FIG. 17 shows an example of beam scanning by a planar antenna.

Next, for example, an example applied to radio equipment to communicate between a satellite station and an earth station is shown in FIG. 13. In the example shown in the figure, an array antenna portion and a phase shifter portion to control the feed phase to the array antenna portion and others are provided on a rotating table. In the array antenna portion and phase shifter portion, any construction of the array antenna devices already shown in the several embodiments may be used.

A converter changes the received signal to be output from the phase shifter portion into an intermediate-frequency signal and outputs the signal to a receiver. Further, an antenna control circuit monitors the level of the received signal, and when the signal is reduced to less than a fixed value a magnetic declination control circuit or elevation angle control circuit is activated. The magnetic declination control circuit drives a motor to turn the rotating table. The elevation angle control circuit displaces the moving portion of the phase shifter portion.

If the time-dependent relative position between a transmitter station (satellite station) as a communication partner and a receiver station (earth station) is predictable beforehand, the function of the antenna control circuit is only to make the magnetic declination control circuit activated to turn the rotating table with a fixed angle to be in a fixed direction in accordance with a lowered output level of the converter and to make the elevation angle control circuit activated to displace the moving portion of the phase shifter portion in a fixed direction for a fixed distance. If the relative position between the above transmitter station and the receiver station is not predictable, by changing the magnetic declination or elevation angle to a minimum, the inclination of the changing output level from the converter is detected and then the magnetic declination and elevation angle are controlled so as to maximize the output from the converter, and only a control is required so that the receiving beam of the array antenna portion constantly faces the side of the transmitter station.

Moreover, regarding displacement of the moving portion of the phase shifter portion, for example, a rack gear is provided to the moving portion and a pinion gear to engage the rack gear is provided on the rotating axis of the motor, and then the moving portion is linearly displaced by the rotation of the motor. Alternatively, the moving portion may be linearly displaced by providing a spirally cut female screw to the moving portion and by turning a male screw supported on the side of the fixed portion through the rotating motor. Further, a worm gear may be used. Moreover, by construction of a linear motor using magnetic poles linearly arranged between the moving portion and the fixed portion the moving portion may be able to be linearly displaced directly.

According to the present invention, by displacement of a second line to be coupled with a first line on the side of a fixed portion and a feed portion respectively, the feed point to the feed portion is changed and the feed phase and feed power to a plurality of element antennas connected to the feed portion are changed. Then, as the directivity of a beam determined by these is changed, only by mechanically displacing a part of an array antenna device, the beam scanning is made to be easily performed by means of the synthesis of a directional pattern. Therefore, the transmitter-receiver system is not as complicated as conventional frequency scanning systems and does not require high-cost semiconductor elements and electronic switches for ultra high frequency applications as required in conventional phase scanning systems, and accordingly they are made low-cost as a whole. Furthermore, the beam scanning in the invention does not become stepwise different from conventional scanning systems of switching feed points, and finer scanning and continuous scanning are made possible with the invention.

Further, according to the present invention, because a feed circuit is provided so as to make the amplitude of each element antenna an equal amplitude distribution, the aperture efficiency is increased and the gain is improved. Furthermore, because a plane normal to the surface on which an array antenna is formed is able to be scanned with a beam, the capability of being put into an assembly of equipment is improved.

Further, according to the present invention, because first and second lines are composed of dielectric lines and a feed portion is composed of a microstrip line, it is able to easily construct a directional coupler of dielectric lines where the first and second lines are able to be relatively displaced and to easily construct patch antennas of microstrips on a board constituting the feed portion. Accordingly, a small-sized array antenna device as a whole is able to be obtained.

While the invention has been particularly shown and described with reference to preferred embodiments, it will be understood by those skilled in the art that the foregoing and other changes in form and details can be made without departing from the spirit and scope of the invention.

What is claimed is:

1. An array antenna device comprising an array antenna having a plurality of element antennas and a linear feed portion used in common for the plurality of element antennas, a first line for transmitting a transmission signal or reception signal, and a second line electromagnetically coupled to the first line and the feed portion respectively and for communicating a signal between the first line and the feed portion, wherein the second line is provided so as to be freely displaced from the first line and the feed portion, and wherein by the displacement, a coupling position of the second line to the first line and the feed portion is changed.

2. The array antenna device of claim 1, wherein a plurality of linear array antennas each of which has a plurality of element antennas are arranged nearly in parallel and connected to the feed portion, and wherein a feed circuit is coupled to the array antennas so that a distribution of an excitation amplitude of each of the element antennas is made a substantially equal amplitude distribution.

3. The array antenna device of claim 1, wherein the first and second lines comprise dielectric lines and the feed portion comprises a microstrip line.

4. The array antenna device of claim 2, wherein the first and second lines comprise dielectric lines and the feed portion comprises a microstrip line.

5. The array antenna device of claim 2, wherein the plurality of element antennas and feed portion are located on an array antenna portion, the first line comprising a first fixed portion; and a movable portion having the second line disposed thereon, the movable portion being movable with respect to the array antenna portion and the first fixed portion.

6. The array antenna device of claim 5, wherein by displacement of the movable portion, a feed point to the feed portion is changed and a feed phase to each linear array antenna and a feed power to each element antenna are changed.

7. The array antenna device of claim 5, wherein the element antennas comprise one of patch antennas, strip antennas, wave guide antennas and slot antennas.

8. The array antenna device of claim 5, wherein the array antenna portion and the movable portion are coupled through a slot.

9. Radio equipment using an array antenna device, the array antenna device comprising an array antenna having a plurality of element antennas and a linear feed portion used in common for the plurality of element antennas, a first line for transmitting a transmission signal or reception signal, and a second line electromagnetically coupled to the first line and the feed portion respectively and for communicating a signal between the first line and the feed portion, wherein the second line is provided so as to be freely displaced from the first line and the feed portion, and wherein by the displacement, a coupling position of the second line to the first line and the feed portion is changed;

further comprising a driver for displacing the second line relative to the first line and the feed portion, and wherein a transmitter circuit or receiver circuit is connected to the first line.

10. The radio equipment of claim 9, wherein a plurality of linear array antennas each of which has a plurality of element antennas are arranged nearly in parallel and connected to the feed portion, and wherein a feed circuit is coupled to the array antennas so that a distribution of an excitation amplitude of each of the element antennas is made a substantially equal amplitude distribution.

11. The radio equipment of claim 9, wherein the first and second lines comprise dielectric lines and the feed portion comprises a microstrip line.

12. The radio equipment of claim 10, wherein the first and second lines comprise dielectric lines and the feed portion comprises a microstrip line.

13. The radio equipment of claim 10, wherein the plurality of element antennas and feed portion are located on an array antenna portion, the first line comprising a first fixed portion; and a movable portion having the second line disposed thereon, the movable portion being movable with respect to the array antenna portion and the first fixed portion.

14. The radio equipment of claim 13, wherein by displacement of the moveable portion, a feed point to the feed portion is changed and a fee phase to each linear array antenna and a feed power to each element antenna are changed.

15. The radio equipment of claim 13, wherein the element antennas comprise one of patch antennas, strip antennas, wave guide antennas and slot antennas.

16. The radio equipment of claim 13, wherein the array antenna portion and the movable portion are coupled through a slot.

* * * * *